US006347866B1

(12) United States Patent
Sunderrajan et al.

(10) Patent No.: US 6,347,866 B1
(45) Date of Patent: Feb. 19, 2002

(54) INK JET PRINTING METHOD

(75) Inventors: Suresh Sunderrajan; Sridhar Sadasivan, both of Rochester; Michelle M. Oakland, Macedon; Patrick J. Whittaker, Webster; John W. Janssen, Williamson; Craig T. Mollon, Batavia, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/452,822

(22) Filed: Dec. 1, 1999

(51) Int. Cl.[7] ..... B41J 2/01; B41M 5/00
(52) U.S. Cl. ..... 347/100; 428/212
(58) Field of Search ..... 347/23, 100, 101, 347/221; 428/212, 195, 427, 511, 537.5; 503/219

(56) References Cited

U.S. PATENT DOCUMENTS 5,850,237 A * 12/1998 Slade ..... 347/23
5,851,651 A 12/1998 Chao ..... 428/327
5,908,723 A 6/1999 Malhotra et al. ..... 430/31
6,140,390 A * 10/2000 Bugner et al. ..... 523/160
6,170,944 B1 * 1/2001 Romano, Jr. et al. ..... 347/101
6,177,177 B1 * 1/2001 Herrmann et al. ..... 428/212

FOREIGN PATENT DOCUMENTS

EP 1 013 464 A 6/2000
WO WO 00 02736 A 1/2000

* cited by examiner

*Primary Examiner*—Anh T. N. Vo
(74) *Attorney, Agent, or Firm*—Harold E. Cole

(57) ABSTRACT

An ink jet printing method having the steps of: a) providing an ink jet printer that is responsive to digital data signals; b) loading the printer with an ink jet recording element of a substrate having thereon an image-receiving layer of an inorganic, anionic pigment, an organic, anionic binder, an organic, cationic mordant and thermoplastic polymer particles; c) loading the printer with an ink jet ink composition; and d) printing on the recording element using the ink jet ink in response to the digital data signals.

10 Claims, No Drawings

INK JET PRINTING METHOD

CROSS REFERENCE TO RELATED APPLICATIONS

Reference is made to commonly assigned, co-pending U.S. patent application Ser. Nos.:

Ser. No. 09/451,809, filed Dec. 1, 1999 by Sadasivan et al. entitled "Method of Preparing a Stable Coating";

Ser. No. 09/451,786, filed Dec. 1, 1999 by Sadasivan et al. entitled "Ink Jet Recording Element";

Ser. No. 09/452,396, filed Dec. 1, 1999 by Sadasivan et al. entitled "Ink Jet Printing Method"; and Ser. No. 09/452,595, filed Dec. 1, 1999 by Sunderrajan et al. entitled "Glossy Ink Jet Recording Element".

FIELD OF THE INVENTION

This invention relates to an ink jet printing method. More particularly, this invention relates to an ink jet printing method that uses a recording element containing pigments.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

Be readily wetted so there is no puddling, i.e., coalescence of adjacent ink dots, which leads to nonuniform density Exhibit no image bleeding Exhibit the ability to absorb high concentrations of ink and dry quickly to avoid elements blocking together when stacked against subsequent prints or other surfaces Provide a high level of gloss and avoid differential gloss Exhibit no discontinuities or defects due to interactions between the support and/or layer(s), such as cracking, repellencies, comb lines and the like Not allow unabsorbed dyes to aggregate at the free surface causing dye crystallization, which results in bloom or bronzing effects in the imaged areas Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality and high gloss but exhibit poor ink dry time. Recording elements that use porous coatings typically have poorer image quality and lower gloss but exhibit superior dry times.

U.S. Pat. No. 5,851,651 relates to an ink jet recording element comprising a paper substrate with a coating comprising inorganic pigments, thermoplastic polymer particles, and an anionic, organic co-binder system. The co-binder system consists of polyvinyl alcohol (PVOH) and polyvinylpyrrolidone (PVP) or a copolymer of polyvinylpyrrolidone-vinyl acetate (PVP-VA). However, there is a problem with this element in that less than desirable image quality, as measured by optical density, image bleed, and waterfastness, is obtained.

The above-mentioned U.S. Ser. No. 09/451,786 by Sadasivan et al., entitled "Ink Jet Recording Element", relates to an ink jet recording element which provides improved image quality through the incorporation of mordants that have a specific and high affinity for dyes used in inkjet inks. While these elements have good image quality, there is a need to improve the gloss of these coatings.

It is an object of this invention to provide an ink jet printing method that uses a recording element that has a fast ink dry time. It is another object of this invention to provide an ink jet printing method that uses a recording element that has good image quality. It is another object of this invention to provide an ink jet printing method that uses a recording element that has high gloss.

SUMMARY OF THE INVENTION

These and other objects are achieved in accordance with the invention which comprises an ink jet printing method comprising the steps of:

a) providing an ink jet printer that is responsive to digital data signals;

b) loading the printer with an ink jet recording element comprising a substrate having thereon an image-receiving layer comprising an inorganic, anionic pigment, an organic, anionic binder, an organic, cationic mordant and thermoplastic polymer particles;

c) loading the printer with an ink jet ink composition; and d) printing on the recording element using the ink jet ink in response to the digital data signals.

The ink jet recording element produced by the method of the invention provides good gloss, good image quality and fast ink dry times.

DETAILED DESCRIPTION OF THE INVENTION

The inorganic, anionic pigment useful in the recording element employed in the process of the invention may be a kaolin clay, a calcined clay, titanium dioxide, talc or a silicate. In a preferred embodiment of the invention, the inorganic, anionic pigment is a kaolin clay sold under the trade name Hydragloss® 92 (J. M. Huber Company). The amount of inorganic, anionic pigment used may range from about 50% to about 95% of the image-receiving layer.

The organic, anionic binder useful in the recording element employed in the process of the invention may be a styrene acrylic latex, a styrene butadiene latex, a poly(vinyl alcohol) or a poly(vinyl acetate). A commercially-available styrene acrylic latex useful in the invention is Acronal® S-728 (BASF Corp.). A commercially-available styrene butadiene latex useful in the invention is Styronal® BN 4606X (BASF Corp.). A commercially-available poly(vinyl alcohol) useful in the invention is Airvol® 21-205 (Air Products Inc.). A commercially-available poly(vinyl acetate) useful in the invention is Vinac® 884 (Air Products Inc.).

The organic, anionic binder may be used in an amount of from about 5% to about 20% of the image-receiving layer. In general, good results are obtained when the ratio of pigment to binder is from about 6:1 to about 8:1.

In a preferred embodiment of the invention, the thermoplastic polymer particles used in the recording element employed in the process of the invention may be formed from a polymer or copolymer having a glass transition temperature below about 70° C., preferably below about 50° C. Commercially-available thermoplastic polymer particles useful in the invention include styrene acrylic hollow sphere dispersions, such as Ropaque® 543 (Rohm & Haas Co.). Other commercially-available thermoplastic polymer particles useful in the invention include solid sphere styrene acrylic latices, such as Dow Latex® 755 (Dow Chemical Co).

The thermoplastic polymer particles may be used in an amount of from about 2% to about 20% of the image-receiving layer.

The organic, cationic mordant useful in the recording element employed in the process of the invention may be a polymer latex dispersion or a water-soluble polymer solution. Examples of mordants useful in the invention are disclosed in U.S. Pat. No. 5,474,843. Other useful mordants include cationic urethane dispersions sold under the trade name Witcobond® W-213 and Witcobond®W-215 (Witco Corporation).

In a preferred embodiment of the invention, the organic, cationic mordant is:

M1: poly(N-vinyl benzyl-N-benzyl-N,N-dimethyl ammonium chloride-co-styrene-co-divinyl benzene), M2: poly(N-vinylbenzyl-N,N,N-trimethylammonium chloride-co-ethylene glycol dimethacrylate), or M3: poly(N-vinylbenzyl-N,N,N-trimethylammonium chloride-co-divinyl benzene).

In general, good results have been obtained when the mordant polymer is present in an amount of from about 1% to about 75% by weight of the image-receiving layer, preferably from about 10% to about 20%.

Smaller quantities of up to about 10% of other binders may also be added to the image-receiving layer such as PVP sold as Luviskol®VA 64W (BASF Corp.) or copolymer PVP-VA sold as Luviquat® PQ11PN (BASF Corp.). In addition to the above major components, other additives such as pH-modifiers like nitric acid, cross-linkers, rheology modifiers, surfactants, UV-absorbers, biocides, lubricants, dyes, optical brighteners etc. may be added as needed.

The substrate may be porous such as paper or non-porous such as cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed. In a preferred embodiment, the coating formulation would have a coating solids of 40–60% and a low shear (100 rpm Brookfield) viscosity of 500–2000 centiPoise.

The image-receiving layer thickness may range from about 5 to about 60 $\mu$m, preferably from about 20 to about 40 $\mu$m. The coating thickness required is determined through the need for the coating to act as a sump for absorption of ink solvent and the need to hold the ink near the coating surface. The coating may be applied in a single layer or in multiple layers so the functionality of each coating layer may be specified; for example, a two-layer structure can be created wherein the base coat functions as a sump for absorption of ink solvent while the top coat holds the ink.

After coating, the ink jet recording element may be subject to calendering or supercalendering to enhance surface smoothness. In a preferred embodiment of the invention, the ink jet recording element is subject to hot, soft-nip calendering at a temperature of about 65° C. and pressure of 14000 kg/m at a speed of from about 0.15 m/s to about 0.3 m/s.

The substrate used in the ink jet recording element employed in the process of the invention may be opaque, translucent, or transparent. There may be used, for example, plain papers, resin-coated papers, various plastics including a polyester resin such as poly(ethylene terephthalate), poly (ethylene naphthalate) and poly(ester diacetate), a polycarbonate resin, a fluorine resin such as poly(tetra-fluoro ethylene), metal foil, various glass materials, and the like. The thickness of the substrate employed in the invention can be from about 12 to about 500 $\mu$m, preferably from about 75 to about 300 $\mu$m.

Ink jet inks used to image the recording elements employed in the process of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples further illustrate the invention.

EXAMPLES

Example 1

Coating formulations were prepared as follows (in dry grams):

| Constituent | Control Coating 1 | Coating 1 of the Invention | Coating 2 of the Invention |
|---|---|---|---|
| Kaolin clay (Hydragloss ® 92) as a dry powder | 100 | 100 | 100 |
| Mordant M3 as a 15% solids dispersion | 30 | 30 | 30 |

-continued

| Constituent | Control Coating 1 | Coating 1 of the Invention | Coating 2 of the Invention |
|---|---|---|---|
| PVP (Luviskol ® 64W) as a 50% solids solution | — | — | 10 |
| Styrene acrylic latex (Acronal ® S728) as a 50% solids dispersion | 10 | 10 | 1.0 |
| Dow Latex ® 755 as a 55% solids dispersion | — | — | 10 |
| Ropaque ® HP-543 as a 30% solids dispersion | — | 10 | — |
| Nitric Acid (1N) | 1.0 | 1.0 | 1.0 |

The above kaolin clay and styrene acrylic latex are both predominantly anionic. The mordant polymer M3 is cationic. The coating formulation thus comprises a mixture of anionic and cationic materials. To achieve a stable formulation, it is necessary to minimize the anionic charge keeping the cationic charge constant. This is achieved by adjusting the pH of the kaolin clay and styrene acrylic latex using nitric acid.

In addition, in order to achieve a stable formulation, the kaolin clay and styrene acrylic latex are added to the cationic Mordant M3 and then the pH is adjusted. Further details of this method are found in copending U.S. patent application Ser. No. 09/451,809, by Sadasivan et al., entitled "Method of Preparing a Stable Coating".

Each coating was applied onto a paper base using a wire wound Meyer rod of wire diameter 0.51 $\mu$m with a wet laydown thickness of 40 $\mu$m to form Control Element 1 and Elements 1 and 2 of the Invention. The base paper used was Nekoosa Solutions Smooth® (Georgia Pacific), Grade 5128 (Carrara White®, Color 9220), basis weight 150 g/m$^2$. After application, the elements were air-dried. The Elements were then subjected to hot, soft-nip calendering at a temperature of 65° C. and pressure of 14,000 kg/m at a speed of 0.3 m/s.

Samples from each of the elements above were printed on a Hewlett Packard Photosmart® printer with printer settings at "photoglossy paper, best" and subsequently tested for dry time and optical density of the composite black stripe. The inks used were Hewlett Packard Photosmart® inks.

Dry time, defined as the time after printing at which no ink retransfer from the printed element to a blotting sheet is observed, was measured using a blotting technique. One sample per element was subjected to the dry time test. A striped target was printed comprising 100% coverage of yellow, cyan, and magenta, 200% coverage for red, green, and blue, and 300% coverage for black in areas of 1 cm by 23 cm. Immediately after printing was finished, the sample was placed on a foam base, a piece of copy paper placed on top of the sample, and a weighted smooth rod was rolled over the paper. The copy sheet was then taken off the sample and studied for retransfer. The results in Table 1 are given as ratings from 1–5, where 1 corresponds to no transfer (fast dry time) to the copy paper, while 5 corresponds to complete transfer (the whole stripe is visible on the copy paper).

Optical density of the printed recording elements was measured using a X-Rite® model 820 transmission/reflection densitometer with status A filtration. The black stripe on the target was tested. The results are the average of three measurements.

Gloss of the recording elements was measured using a Gardner Tri-gloss meter at the 60-degree setting according to the ASTM D523 standard. The following results were obtained:

TABLE 1

| Element | Dry time | Optical Density (Composite Black) | Gloss Pre-Calender | Gloss Post-Calender |
|---|---|---|---|---|
| Control 1 | 1 | 01.61 | 17.1 | 30.9 |
| Invention 1 | 1 | 1.66 | 18.2 | 55.1 |
| Invention 2 | 1 | 1.63 | 16.5 | 54.5 |

The above results show that Elements 1 and 2 employed in the process of the invention had a higher gloss as compared to the Control Element 1, while maintaining a fast dry time and good optical density.

Example 2

Waterfastness, defined as the loss in image optical density after prolonged submersion in water, was measured using a soak test. The ink jet recording elements of Example 1 were soaked in distilled water for five minutes with mild agitation. The elements were then allowed to dry on a bench-top overnight. The optical density was measured before and after immersion and the % change in density of each color stripe was recorded. The following results were obtained:

TABLE 2

| | Waterfastness | | | |
|---|---|---|---|---|
| Element | % Change in Cyan Density | % Change in Magenta Density | % Change in Yellow Density | % Change in Black Density |
| Control 1 | −3 | 2 | 3 | −10 |
| Invention 1 | −3 | −1 | −2 | −9 |
| Invention 2 | −1 | −1 | −3 | −9 |

The above results show that Elements 1 and 2 employed in the process of the invention had equivalent waterfastness as compared to Control Element 1.

This invention has been described with particular reference to preferred embodiments thereof but it will be understood that modifications can be made within the spirit and scope of the invention.

What is claimed is:

1. An ink jet printing method comprising the steps of:

a) providing an ink jet printer that is responsive to digital data signals;

b) loading said printer with an ink jet recording element comprising a substrate having thereon an image-receiving layer comprising an inorganic, anionic pigment, an organic, anionic binder, an organic, cationic mordant and thermoplastic polymer particles;

said inorganic, anionic pigment being present in an amount of from about 50% to about 95 weight % of said image-receiving layer;

said organic, anionic binder being present in an amount of from about 5% to about 20 weight % of said image-receiving layer;

said organic, cationic mordant being present in an amount of from about 1% to about 75 weight % of said image-receiving layer; and said thermoplastic polymer particles being present in an amount of from about 2% to about 20 weight % of said image-receiving layer;

c) loading said printer with an ink jet ink composition; and d) printing on said recording element using said ink jet ink composition in response to said digital data signals.

2. The ink jet printing method of claim 1 wherein said inorganic, anionic pigment is a kaolin clay, a calcined clay, titanium dioxide, talc or a silicate.

3. The ink jet printing method of claim 1 wherein said inorganic, anionic pigment is a kaolin clay.

4. The ink jet printing method of claim 1 wherein said organic, anionic binder is a styrene acrylic latex, a styrene butadiene latex, a poly(vinyl alcohol), or a poly(vinyl acetate).

5. The ink jet printing method of claim 1 wherein said organic, anionic binder is a styrene acrylic latex.

6. The ink jet printing method of claim 1 wherein said organic, cationic mordant is a polymer latex dispersion, a water-soluble polymer solution or a cationic urethane dispersion.

7. The ink jet printing method of claim 1 wherein said organic, cationic mordant is poly(N-vinyl benzyl-N-benzyl-N,N-dimethyl ammonium chloride-co-styrene-co-divinyl benzene); poly(N-vinylbenzyl-N,N,N-trimethylammonium chloride-co-ethylene glycol dimethacrylate); or poly(N-vinylbenzyl-N,N,N-trimethylammonium chloride-co-divinyl benzene).

8. The ink jet printing method of claim 1 wherein said organic, cationic mordant is poly(N-vinylbenzyl-N,N,N-trimethylammonium chloride-co-divinyl benzene).

9. The ink jet printing method of claim 1 wherein said thermoplastic polymer particles are polymers or copolymers having a glass transition temperature below about 70° C.

10. The ink jet printing method of claim 1 wherein said thermoplastic polymer particles are styrene acrylic hollow sphere dispersions or solid sphere styrene acrylic latices.

* * * * *